US011739921B2

(12) United States Patent
Elmvang

(10) Patent No.: US 11,739,921 B2
(45) Date of Patent: Aug. 29, 2023

(54) MODULAR LIGHTING DEVICE COMPRISING AN ADJUSTABLE MOUNTING MECHANISM

(71) Applicant: Fischer Lighting Holding ApS, Vanløse (DK)

(72) Inventor: Stig Elmvang, Skovlunde (DK)

(73) Assignee: Fischer Lighting Holding ApS, Vanlose (DK)

( * ) Notice: Subject to any disclaimer, the term of this patent is extended or adjusted under 35 U.S.C. 154(b) by 401 days.

(21) Appl. No.: 16/903,748

(22) Filed: Jun. 17, 2020

(65) Prior Publication Data

US 2020/0400292 A1 Dec. 24, 2020

(30) Foreign Application Priority Data

Jun. 18, 2019 (EP) ..... 19180941

(51) Int. Cl.

| | |
|---|---|
| ***F21V 21/14*** | (2006.01) |
| ***F21V 29/70*** | (2015.01) |
| ***F21S 8/02*** | (2006.01) |
| ***F21V 17/10*** | (2006.01) |
| ***F21V 23/00*** | (2015.01) |

(52) U.S. Cl.

CPC ..... *F21V 21/14* (2013.01); *F21S 8/02* (2013.01); *F21V 17/105* (2013.01); *F21V 23/008* (2013.01); *F21V 29/70* (2015.01)

(58) Field of Classification Search

CPC ..... F21V 21/14; F21V 29/70; F21V 17/105; F21V 23/008; F21S 8/02

See application file for complete search history.

(56) References Cited

U.S. PATENT DOCUMENTS

| | | | | |
|---|---|---|---|---|
| 5,363,295 | A | 11/1994 | DeKleine et al. | |
| 5,673,997 | A | 10/1997 | Akiyama | |
| 8,888,332 | B2 * | 11/2014 | Martis | F21V 5/04 362/398 |
| 9,383,087 | B2 | 7/2016 | Rashidi Doust | |
| 9,903,571 | B2 | 2/2018 | Schubert et al. | |
| 9,939,136 | B2 | 4/2018 | Vidal | |
| 10,240,764 | B2 | 3/2019 | Morales | |

(Continued)

FOREIGN PATENT DOCUMENTS

| | | |
|---|---|---|
| CN | 207962568 U | 10/2018 |
| DE | 19608583 A1 | 9/1996 |

(Continued)

OTHER PUBLICATIONS

European Search Report dated Oct. 16, 2020, European application No. EP20180515.

*Primary Examiner* — Thomas M Sember

(74) *Attorney, Agent, or Firm* — Dinsmore & Shohl LLP

(57) ABSTRACT

A modular lighting device may mounted into architectural finished surfaces such as ceilings, walls and floors. The device comprising an adjustable mounting mechanism that allows the lighting device to be fitted to various sized openings in a surface. One version of the modular lighting device includes a plate for receiving a lamp fitting, three mounting brackets, and a locking ring for restraining the mounting brackets to the plate, wherein the modular lightning device is configured such that it can be fitted to different sized openings via radial adjustment of the mounting brackets.

14 Claims, 12 Drawing Sheets

(56) References Cited

U.S. PATENT DOCUMENTS

| | | | |
|---|---|---|---|
| 2005/0168986 | A1 | 8/2005 | Wegner |
| 2013/0215623 | A1 | 8/2013 | Goodman et al. |
| 2017/0045209 | A1* | 2/2017 | Schubert ..... F21V 21/13 |
| 2017/0248290 | A1 | 8/2017 | Uhler |
| 2018/0224095 | A1 | 8/2018 | Cohen |

FOREIGN PATENT DOCUMENTS

| | | | |
|---|---|---|---|
| EP | 0909919 | A2 | 4/1999 |
| EP | 2637486 | A1 | 9/2013 |
| EP | 3242071 | A1 | 11/2017 |
| GB | 2313184 | A | 11/1997 |
| GB | 2326467 | A | 12/1998 |
| JP | 11162230 | A | 6/1999 |
| KR | 20100077069 | A | 7/2010 |
| WO | 9812472 | A1 | 3/1998 |
| WO | 2005031210 | A1 | 4/2005 |
| WO | 2014053145 | A1 | 4/2014 |
| WO | 2020058528 | A1 | 3/2020 |

* cited by examiner

MODULAR LIGHTING DEVICE COMPRISING AN ADJUSTABLE MOUNTING MECHANISM

CROSS-REFERENCE TO RELATED APPLICATION

This application claims priority from Application No. EP 19180941.7 filed Jun. 18, 2019, the entire content of which is incorporated herein by reference.

FIELD OF THE INVENTION

The present disclosure relates to lighting fixtures, which are mounted into architectural finished surfaces such as ceilings, walls and floors. Specifically, the disclosure relates to a modular lighting device comprising an adjustable mounting mechanism that allows the lighting device to be fitted to various sized openings in the surface.

BACKGROUND OF THE INVENTION

Existing light fixtures installed in ceilings or other planar surfaces of buildings are often replaced for the purpose of upgrading the lighting system used for improved efficacy and quality of light, or during renovation. For lamps recessed or integrated into building surfaces, it is often difficult to install new lamps in the same place as the original lamps were located without damaging the surface on which the existing light fixture is mounted. In some cases it is even necessary to replace the ceiling or refurbish the entire ceiling in order to fit new lamps. This adds a significant cost to the process of upgrading a building's lighting system.

When installing a new light fixture in place of an existing light fixture, it is favourable that the opening in which the existing light fixture is mounted, remains hidden after the new light fixture is fitted to the building. Additionally, it is favourable if the existing opening in the wall or ceiling can be re-used for the instalment of the new light fixture. In general, this is complicated by the fact that light fixtures come in many different shapes and sizes. Therefore, it is often needed to either enlarging the opening or refurbish the entire surface, both of which are costly and time-consuming.

Therefore, there is a need for a solution whereby existing openings in surfaces such as walls or ceilings may be used for fitting new light fixtures without modifying the opening or without being limited to light fixtures of a certain size to cover the opening. Additionally, such a solution should preferably be cost-efficient, easy to mount, and environmentally friendly.

International patent application WO 2020/058528 entitled "Modular lighting device" by the same applicant addresses some issues related to retrofitting new lighting devices. However, it would be advantageous to provide a solution, which is not dependent and limited by the shape and size of the existing lamp-housing.

SUMMARY OF THE INVENTION

The presently disclosed modular lighting device offers a solution whereby existing openings of varying sizes in walls or ceilings may be used without the need of modifying the size of the opening or repairing the wall/ceiling when installing/fitting new light fixtures.

The presently disclosed modular lighting device can be fitted to a variety of different sized openings. This is achieved by providing the device with an adjustable mounting mechanism, which can be fitted to different sized apertures as well as different ceiling/wall thicknesses. In one embodiment of the present disclosure, the modular lighting device comprises a plate for receiving a lamp fitting, at least three mounting brackets; and a locking ring for restraining said mounting brackets to the plate. In this embodiment, the modular lightning device is configured such that it can be fitted to different sized openings via radial adjustment of the mounting brackets. In addition, the modular lightning device may preferably be fixed to different sized ceiling thicknesses via vertical adjustment of the mounting brackets, or via vertical adjustment of a clamp attached to each of the mounting brackets. Accordingly, the modular lighting device may be configured to fit different wall/ceiling thicknesses.

The presently disclosed modular lighting device is primarily intended as a new fitting, which is countersunk into an opening in a ceiling or a wall. The modular lighting device is compatible with a variety of different components such as lamp fittings, light sources, heat sinks, reflectors, diffusers, and drivers for the light source. The lighting device is shown with a variety of compatible components in the FIGS. 7-16. Thus, the presently disclosed lighting device is very modular in its design, allowing for many different designs to be realized by changing one or more components in the light fixture. Many of such components that are compatible with the presently disclosed lighting device are described in earlier applications by the same applicant, e.g. a lamp fitting disclosed in WO 2014/053145, a cooling element disclosed in EP 3 242 071 A1, and a reflector disclosed in WO 2020/058528, all of which are incorporated herein in their entirety.

Another advantage of the presently disclosed modular lighting device is the possibility of installing a light fixture, which provides a more pleasant light, since the components of the modular light fixture can be specifically chosen to provide a certain light (e.g. with a certain colour, temperature or direction). The disclosed modular lighting device allows for different components (lamp fitting, reflector, light source, etc.) to be attached hereto. Accordingly, it is possible to design a light fixture of a certain size and with a specific light distribution and subsequently with ease mount said light fixture in an aperture, without any concern of the size of said aperture, as long as it falls within the range of compatible apertures of the modular lighting device.

According to a preferred embodiment, the modular lighting device is suitable for countersunk fitting into an opening in a ceiling or a wall. According to the preferred embodiment, the modular lighting device comprises a plate for receiving a lamp fitting; at least three mounting brackets; and a locking ring for restraining said mounting brackets to the plate, wherein the modular lightning device is configured such that the modular lightning device can be fitted to different sized openings via radial adjustment of the mounting brackets.

DETAILED DESCRIPTION OF THE INVENTION

In the present context, a mounting bracket should be understood as a generic term referring to any kind of bracket, fixture, or member suitable for mounting/securing a lighting device to a ceiling/wall.

In the present context, two or more mounting brackets may be referred to as a mounting mechanism.

In the present context, the terms vertical and horizontal applies to the situation in which the modular lighting device is installed in a ceiling. Hence, in this situation the terms have the common meanings. However, in case the modular lighting device is installed in a wall, the parts that are referred to as being either vertical or horizontal, e.g. "vertical section", should be understood as the same parts, but oriented differently.

Figure 15:
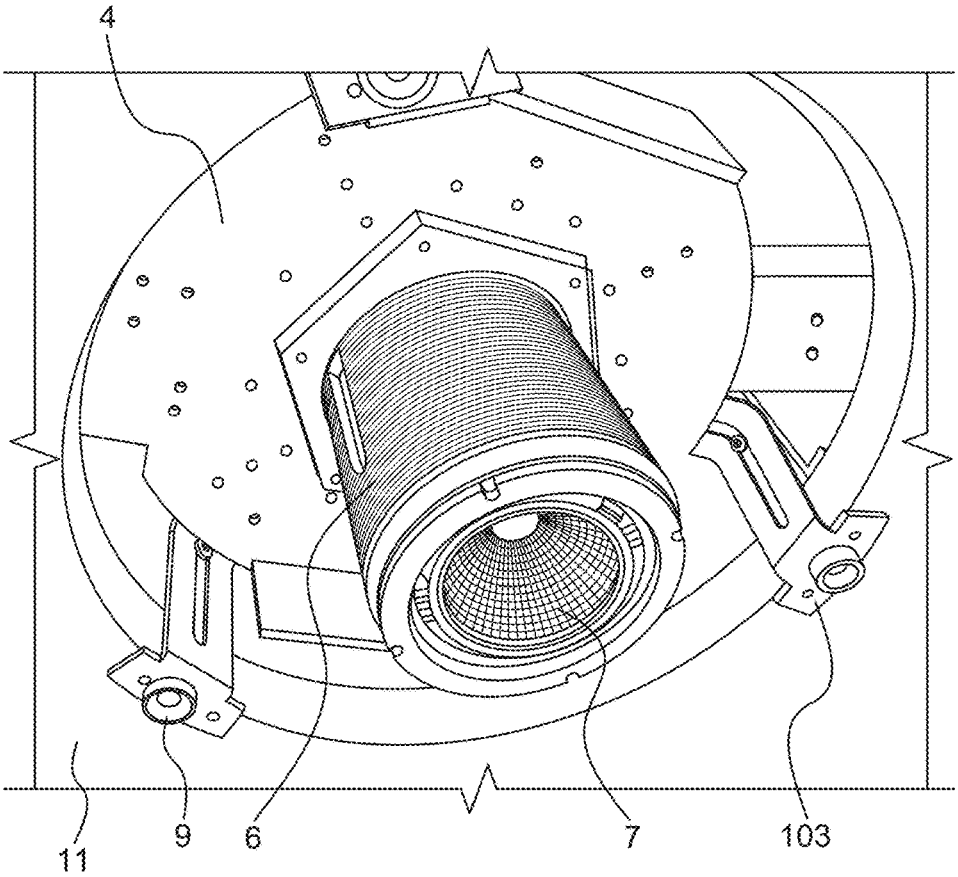
FIG. 15 shows a modular lighting device according to an embodiment of the present disclosure. In this embodiment, a lamp fitting is attached to the lighting device.

The first and second surfaces of the wall/ceiling are defined as indicated in the drawings (cf. FIGS. 15-16).

The present disclosure relates to a modular lighting device for countersunk fitting into an opening in a ceiling or a wall. The modular lighting device preferably comprises a plate for receiving a lamp fitting, at least three mounting brackets, and a locking ring for restraining the mounting brackets to the plate. The modular lightning device is preferably configured such that it can be fitted to different sized openings via radial adjustment of the mounting brackets, and in addition, the modular lightning device may be fixed to different ceiling/wall thicknesses via vertical adjustment of the mounting brackets or by adjusting the position of a clamp attached to each of the mounting brackets, thereby adjusting a vertical gap between the clamp and the mounting bracket.

Lamp Fitting

The modular lightning device is suitable for receiving a lamp fitting, which is preferably configured for receiving a light source for the lighting device. The lamp fitting is preferably configured for attachment to a plate 4 suitable for receiving said lamp fitting. The attachment may be through the use of two holding-rings; one on each side of the plate. The lamp fitting may have a bezel and may be provided with a thread on at least a part, or the whole, of the outside surface. This thread may be used for engaging a reflector, typically toward a bottom section of the lamp fitting. The thread may also be used when attaching to the plate, e.g. by means of two holding-rings, typically on either side of the plate. One purpose of the lamp fitting is to provide a place to locate the light source for the lamp and another purpose is to attach a reflector to the lamp fitting. An example of a lamp fitting compatible with the presently disclosed lighting device is disclosed in WO 2014/053145 by the same applicant, which is hereby enclosed by reference in its entirety. In WO 2014/053145, the presently disclosed lamp fitting is exemplified as a "main body".

Reflector

The modular lighting device comprises a plate 4, which is preferably suitable for receiving a lamp fitting. Typically, the lamp fitting is suitable for engaging with a reflector, such that the reflector is attached to the outside surface of the lamp fitting, e.g. by means of threaded engagement. In case the modular lighting device is equipped with such a lamp fitting, a reflector may be attached. The reflector is provided for reflecting and/or modifying light from the light source. But equally important the reflector is provided to cover the opening of the ceiling or the interior surface of the wall. The reflector may comprise a narrow top section configured for attachment to said lamp fitting, and a wider bottom section for covering said opening. Hence, the reflector is preferably configured such that the bottom section is of a larger diameter than then diameter of the opening. The reflector may also host additional technical or aesthetic features that may attach to it. An example of a reflector compatible with the presently disclosed lighting device is disclosed in WO 2020/058528 by the same applicant, which is hereby enclosed by reference in its entirety.

Light Source

The type of light source may be a light-emitting diode (LED), or an incandescent bulb, or halogen bulb, or a fluorescent light bulb such as s compact fluorescent light bulb (CFL). The light source could also be two or more of the types mentioned or any combination thereof. The light source may comprise a driver. The light source is preferably located at the bottom of a lamp fitting. In most embodiments, this position would correspond to a position near the top section of a reflector. Alternatively, the light source may be located in a reflector attachment element.

Driver

Some type of light sources such as light-emitting diodes (LEDs) require a driver to supply the correct power to the light source. The driver typically serves the purpose of converting an incoming AC power to a proper DC voltage, and additionally regulating the current flowing through the light source during operation to protect the light source from line-voltage fluctuations. As an example, the driver may convert 230V AC to a low-voltage DC power, e.g. 12V, suitable for powering an LED or an array of LEDs. Such drivers may be constant voltage types (usually 10V, 12V and 24V) or constant current types (e.g. 350 mA, 700 mA and 1 A). Some LED drivers are manufactured to operate specific LED devices or arrays, while others can operate most commonly available LEDs. Drivers may also enable dimming and colour changing or sequencing of the light source.

The driver may also be a transformer simply converting from one voltage to another, e.g. from 220-230V AC to 12V DC. Such a transformer may be suitable for powering halogen lights. The driver/transformer may be fixed to the modular lighting device by securing the driver/transformer to a plate suitable for holding such a driver. Alternatively, in some cases the driver is an integral part of the light source. An example of a suitable driver compatible with many embodiments of the lighting device is a Philips Xitanium LED driver.

Plate

The modular lighting device comprises a plate 4 suitable for receiving a lamp fitting, said lamp fitting being suitable for holding a light source. The plate is preferably further configured for holding a driver or a transformer for the light source. Accordingly, the plate may comprise an elongated part 403 for holding a driver for the light source. Preferably, the plate is configured for receiving a lamp fitting similar to the one disclosed in WO 2014/053145 (referred to herein as a main body). The plate 4 is further preferably configured for the attachment of a plurality of mounting brackets 1. To accommodate the need of receiving a lamp fitting, the plate preferably comprises an opening 401, large enough that the lamp fitting can pass through. The plate may further comprise a plurality of smaller holes 402 suitable for securing other features to the plate, e.g. mounting brackets 1 and/or a driver. The smaller holes 402 may be dimensioned to allow a screw or a nut to pass through one of the holes.

One preferred embodiment of the plate comprises a rounded section 404 in one end of the plate with an elongated part 403 protruding from said circular section of the plate. The elongated part 403 of the plate is preferably suitable for holding a driver or a transformer for a light source. The rounded section 404 of the plate preferably comprises an opening 401 suitable for receiving a lamp fitting, as mentioned above. Preferably, the rounded section comprises means, e.g. a plurality of holes, for attaching one or more mounting brackets to the plate. These may be secured to the plate by the use of a locking ring 3; using second fastening elements such as screws, nuts, bolts or combinations thereof (cf. FIG. 5).

Mounting Brackets

The modular lighting device may preferably comprise a plurality of mounting brackets (cf. FIG. 1D) serving the purpose of fitting the lighting device to an opening in a wall or a ceiling recess. The mounting brackets, or the combination of a multiple of mounting brackets, are therefore preferably, either individually or in combination, adjustable in at least one dimension, more preferably in at least two dimensions, most preferably along a multiple of axes wherein at least two of said axes are substantially perpendicular to each other.

The mounting brackets 1 may allow the modular lightning device to be fitted to different sized openings, preferably via radial adjustment of the mounting brackets. The modular lighting device can preferably be fitted to a range of openings, such as approximately 100 mm to approximately 400 mm, or from approximately 120 mm to approximately 300 mm, or from approximately 130 mm to approximately 240 mm. Said radial adjustment can be realized by providing a number of mounting brackets, each comprising a first elongated slot 101 oriented horizontally along a radial axis, i.e. an axis extending radially from the rounded section of the plate, or alternatively an axis extending radially from an attached lamp fitting, which preferably has a circular circumference. Accordingly, the mounting bracket(s) may comprise a first elongated slot 101 provided in a first section 105 of the mounting bracket, said first slot enabling the radial adjustment of each mounting bracket.

Figure 3A:
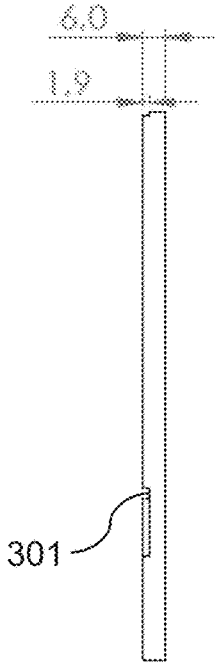
FIG. 3A shows a side view of a locking ring according to the present disclosure. The locking ring preferably features a number of small indentations 301.
Figure 3B:
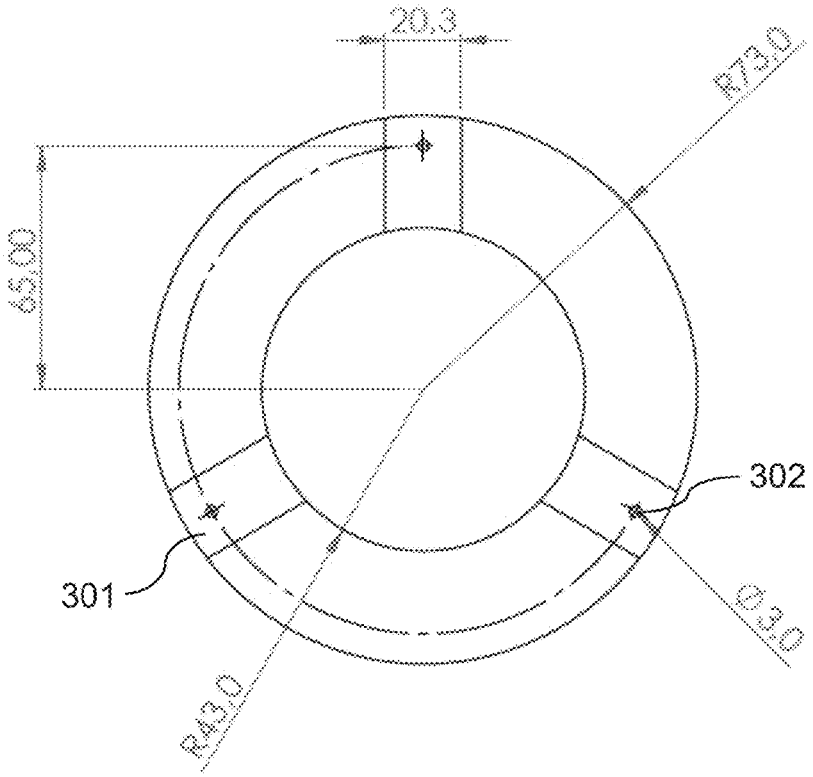
FIG. 3B shows a bottom view of the locking ring shown in FIG. 3A. In this embodiment, the locking ring comprises three indentations 301 to fit three mounting brackets.
Figure 7:
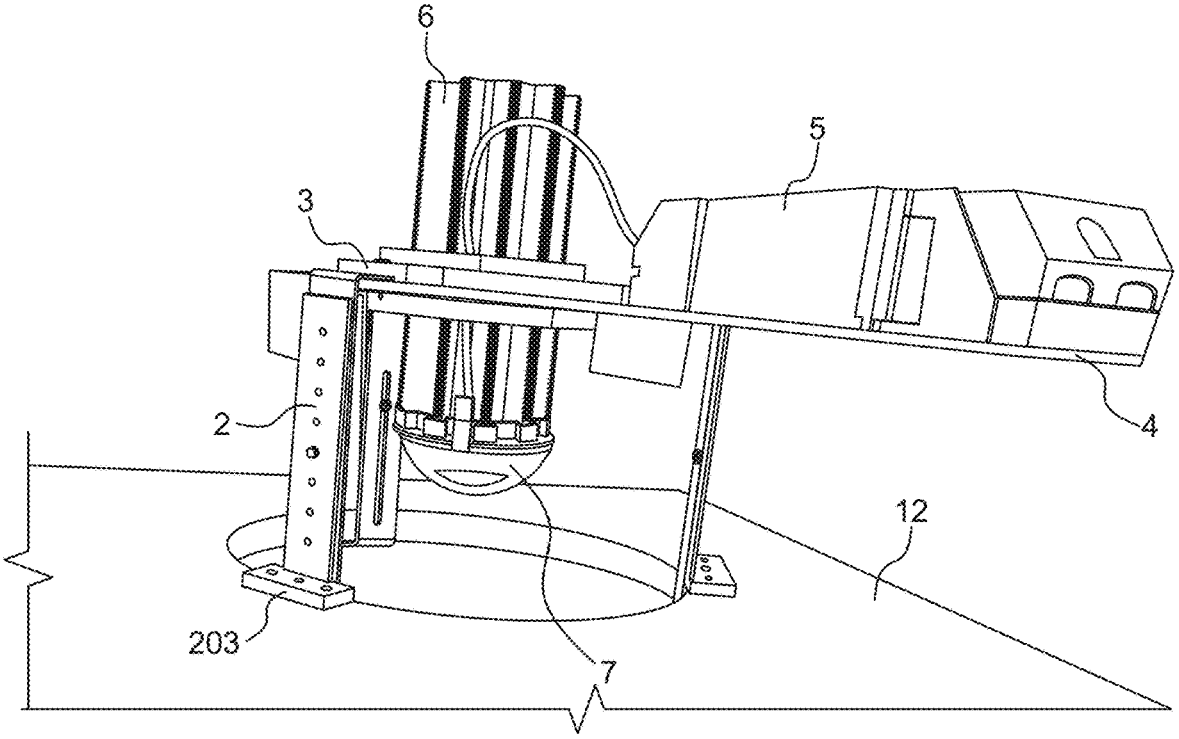
FIG. 7 shows a modular lighting device according to an embodiment of the present disclosure, wherein some different components are attached to the lighting device.
Figure 8:
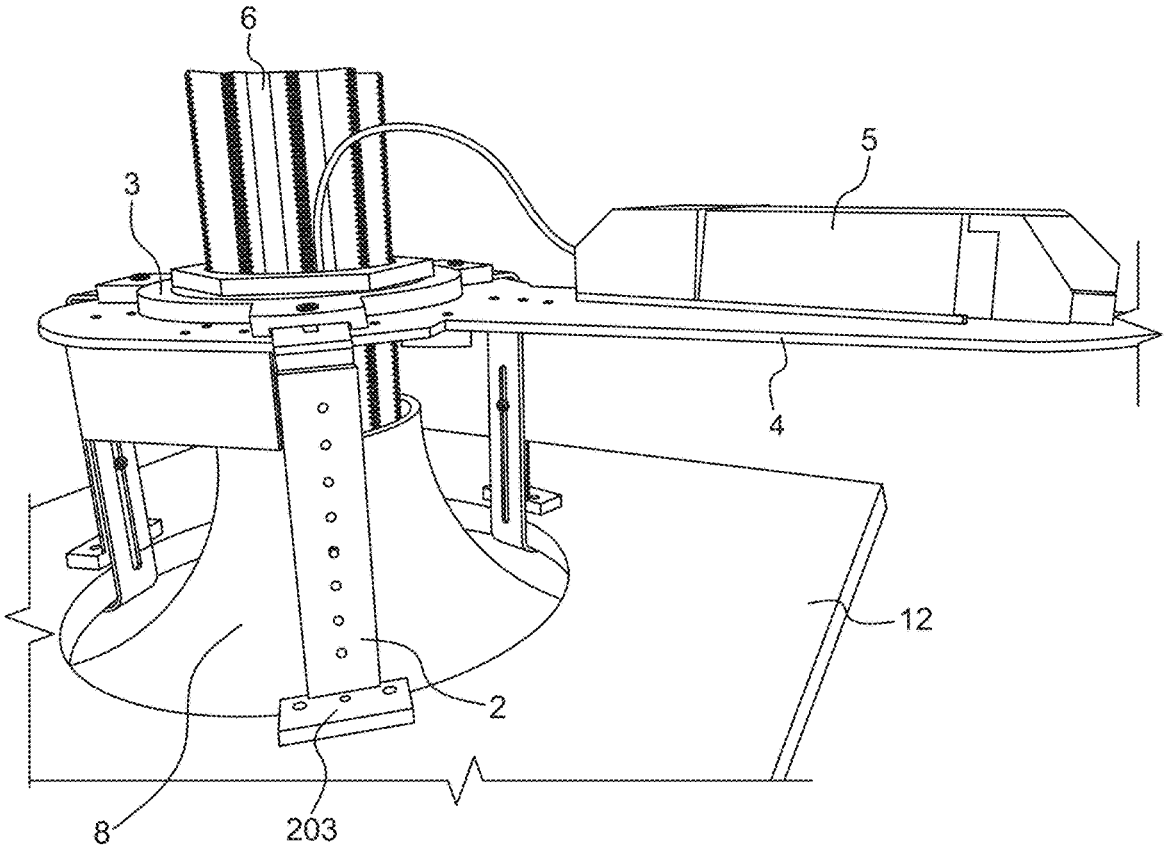
FIG. 8 shows a modular lighting device according to an embodiment of the present disclosure, wherein a reflector 8 is fitted to the lighting device.

In a preferred embodiment, the modular lighting device comprises at least three such mounting brackets, the three brackets preferably positioned symmetrically on the plate such that the mounting brackets divide the rounded section of the plate and/or the locking ring into three substantially equal arc lengths (cf. FIG. 3B). Placing the mounting brackets in such an arrangement allows for an easy radial adjustment of the modular lighting device, while at the same time providing a secure fixation to a ceiling/wall without e.g. the risk of a non-intentional rotation of the modular lighting device. The symmetrical arrangement further eases the positioning of the lighting device in the center of an opening in a ceiling or wall. Furthermore, the use of three mounting brackets arranged symmetrically ensures that the modular lighting device is mechanically stable enough that a driver can be mounted on top of the elongated part 403 of the plate (cf. FIG. 8). FIGS. 7 and 8 show an embodiment of the modular lighting device with different components attached, including a driver.

The mounting brackets may further allow the modular lighting device to be fixed to different ceiling/wall thicknesses by adjusting the mounting brackets and/or one or more clamps attached to the mounting brackets along an axis substantially perpendicular to the plate. In most preferred embodiments, this would correspond to a vertical adjustment of the mounting brackets and/or clamps. The adjustment to different ceiling/wall thicknesses is preferably accomplished by the use of clamps (such as the one shown in FIG. 2D); typically by attaching one clamp to each mounting bracket (cf. FIG. 7). Accordingly, the modular lighting device preferably comprises a plurality of clamps, each of said clamps being moveably attached to a mounting bracket. Each clamp should preferably be able to move vertically up and down, and more preferably the movement of each clamp should be limited to substantially vertical movements when the modular lighting device is installed in a ceiling. This may be realised by providing an elongated, vertical slot 102 in each mounting bracket, which allows the clamp 2 to slide vertically in said slot/opening. Accordingly, each mounting bracket preferably comprises an elongated slot 102 provided in the second section of the mounting bracket. Preferably, each clamp is configured to slide in the second elongated slot 102 of the mounting bracket, such that the movement of each clamp is confined to the dimensions of the second elongated slot 102. When installing the modular lighting device in a ceiling recess, the lighting device may be fixed to the ceiling by adjusting the clamp to the ceiling thickness. The end section of each mounting bracket is preferably bent in an approximately 90 degrees angle such that the end section 103 comprises a substantially horizontal section, suitable for contacting the lower surface of the ceiling (cf. FIG. 9). The clamp positioned above said end section, and with the ability to be adjusted vertically up/down, may then be adjusted to match the ceiling thickness such that the lower part of the clamp 203 contacts the upper surface of the ceiling (cf. FIG. 7-8). A similar approach applies for installing the modular lighting device in an opening in a wall. The modular lighting device can preferably be fitted to a range of wall/ceiling thicknesses, such as approximately 1 mm to approximately 100 mm, or from approximately 2 mm to approximately 30 mm, or from approximately 13 mm to approximately 26 mm. The modular lighting device is suitable for instalment in a variety of different walls and ceilings, including, but not limited to, drywalls and metal ceilings.

The adjustable mounting mechanism may further allow the vertical position of the modular lighting device relative to the ceiling to be adjusted. This may be achieved by providing various kits of mounting brackets of different sizes. One kit may thus comprise three mounting brackets, wherein the second section 106 is shorter than in another kit (cf. FIG. 9 and FIG. 10). The shorter second section may allow parts of the modular lighting device to extend below the ceiling, or alternatively parts that are subsequently mounted on the modular lighting device such as a lamp fitting or a cooling element may extend below the surface. Having a lamp fitting extending below the surface allows for the attachment of a shade, a globe, a pendant or the like to the outer surface of the lamp fitting (cf. FIG. 11).

The adjustment of the vertical position/height of the modular lighting device may also be realized by providing two second sections 106 on one mounting bracket; the two second sections arranged such that they may slide on top of each other in order to adjust the height/length of the resulting second section of the bracket. The two sections should preferably be able to lock against each other, once the desired height is achieved. The mounting brackets may comprise a plastic material or a metal such as aluminium. The mounting brackets may be used in combination with magnets 9 in case they are made of a metal (cf. FIG. 12). The magnets can be used to mount a variety of components, e.g. diffusers, rings, etc., underneath the modular lighting device. FIG. 13 shows a diffuser 10, which is attached to the modular lighting device using magnets; one for each mounting bracket. Accordingly, the foot of each mounting bracket may be configured for attaching one or more magnets such that a diffuser may be removably attached to the modular lighting device.

Locking Ring

Figure 5:
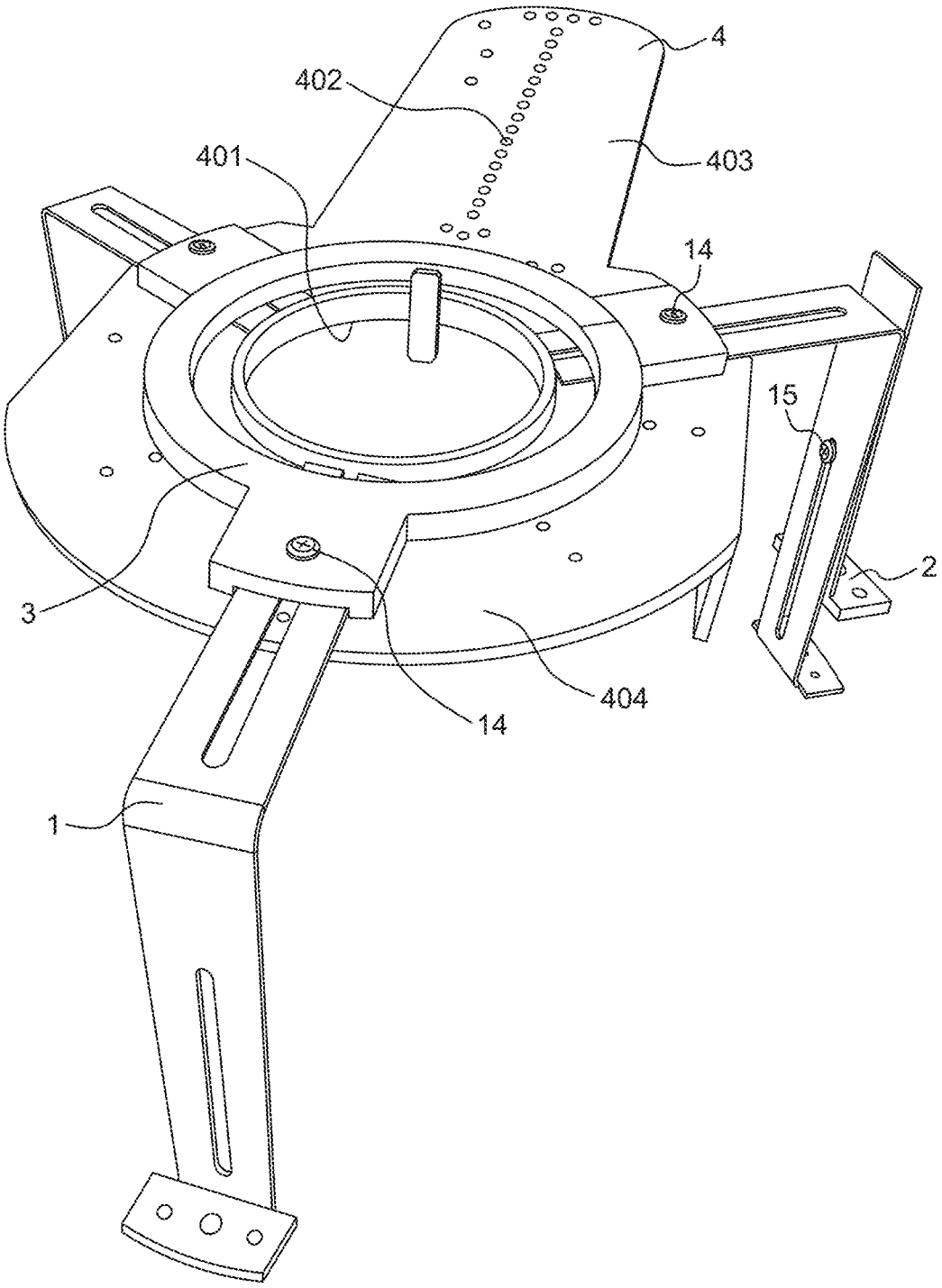
FIG. 5 shows a perspective view of a modular lighting device according to an embodiment of the present disclosure.

The modular lighting device may comprise a locking ring 3 for securing a number of mounting brackets to the plate (cf. FIG. 5). The locking ring is preferably rigid, such that it is suitable for fixing a number of brackets to the plate. The locking ring preferably comprises a hole, which is larger than the opening 401 of the plate. The locking ring preferably comprises at least one indentation 301 for placing a mounting bracket in. More preferably, it comprises one indentation for each mounting bracket. The indentation in combination with the plate preferably defines an opening for receiving the first section of the mounting bracket. The locking ring may comprise in each indentation 301 one or more holes 302 suitable for receiving one or more second fastening elements such as a screw, a bolt, a nut, or similar. The second fastening elements may be used to fix the mounting brackets to the plate using the locking ring. In one embodiment, the second fastening elements comprise screws, wherein one screw is used per mounting bracket to fix the radial position of each mounting bracket (cf. FIG. 5). The second fastening elements are preferably accessible through the opening in the wall/ceiling, such that the mounting brackets may be radially adjusted when facing the first surface of the wall/ceiling.

In another embodiment (not shown in the drawing), the second fastening elements comprise one or more butterfly nuts, which are configured to fix the radial position of each mounting bracket. This arrangement has the advantage that the modular lighting device may be easily adjusted to the opening/aperture in the ceiling/wall from below. Orienting the wing-like projections of each butterfly nut downward, allows for an easy access to the adjustable parts of the lighting device from below, i.e. the brackets can be pulled out radially until they engage the ceiling/wall, and then the butterfly nuts may be tightened to lock the radial position of the mounting brackets. Thus, in this embodiment it is the combination of the plate, the butterfly nuts and the locking ring that ensures the radial positional lock of the mounting brackets. Accordingly, the butterfly nuts are accessible through the opening in the wall/ceiling, such that the mounting brackets can be radially adjusted when facing the first surface of the wall/ceiling. Subsequent to the radial locking, the mounting brackets may be secured to the wall/ceiling by the use of a first fastening element such as a screw inserted through a hole 104 of the foot 103, the screw passing through said hole, the wall and then engaging the foot 203 of the clamp e.g. by passing through hole 202 of the clamp. Said fixation ensures that the entire modular lighting device is prevented from rotational movement. Accordingly, each mounting bracket may comprise a foot configured for mechanically engaging with a first surface of the wall/ceiling, and each clamp may comprise a foot configured for mechanically engaging with a second surface of the wall/ceiling, the foot of the mounting bracket and the foot of the clamp defining an adjustable gap for accommodating different wall/ceiling thicknesses.

DETAILED DESCRIPTION OF DRAWINGS

Figure 1A:
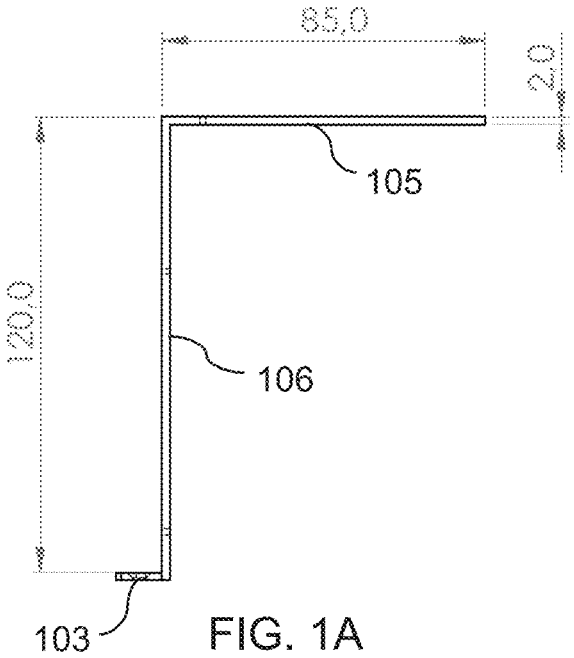
FIG. 1A shows a side view of a mounting bracket 1 comprising a first section 105 and a second section 106, said first and second section preferably arranged to form a right-angled corner.

FIG. 1A shows a side view of a mounting bracket 1 comprising two right-angled corners and two elongated slots (101, 102), which allows the mounting bracket to be adjusted horizontally and vertically, respectively. The specified measurements in millimetres are only provided as an example.

Figure 1B:
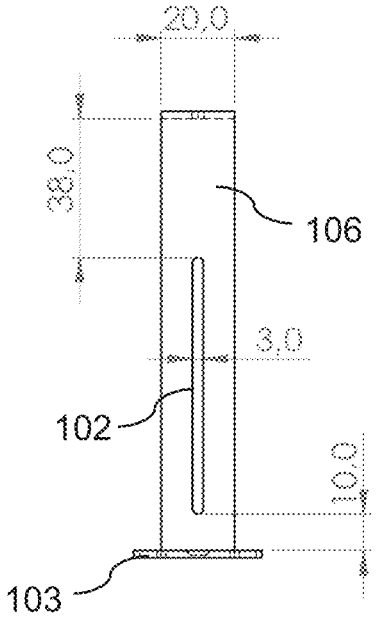
FIG. 1B shows an end view of the mounting bracket shown in FIG. 1A, said view facing the second section 106 of the bracket. The second section 106 preferably comprises a second elongated slot 102.

FIG. 1B shows another side view of the mounting bracket shown in FIG. 1A; this view shows the second section of the bracket, wherein the second elongated slot 102 is visible. A clamp can be attached, using a third fastening element such as a screw, to the second section of the mounting bracket such that the clamp is allowed to move/slide in one dimension via the second elongated slot 102. The clamp may also be attached with a butterfly nut, e.g. from the inside of the lighting device, to ease installation and adjustment. The specified measurements in millimetres are only provided as an example.

Figure 1C:
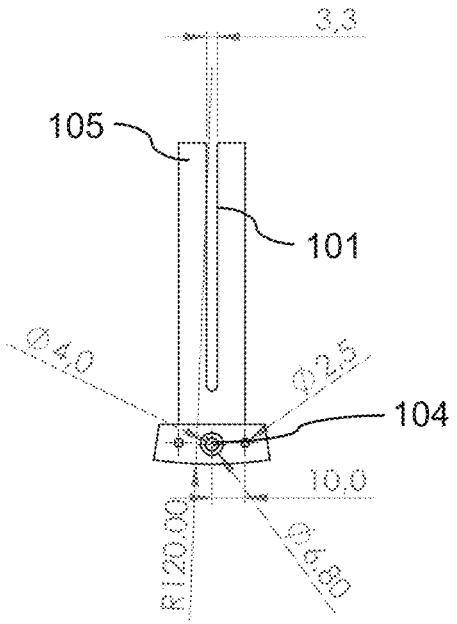
FIG. 1C shows a top view of the mounting bracket shown in FIG. 1A, said view facing the first section 105 of the bracket. The first section 105 preferably comprises a first elongated slot 101, said slot preferably comprising an open end.
Figure 10:
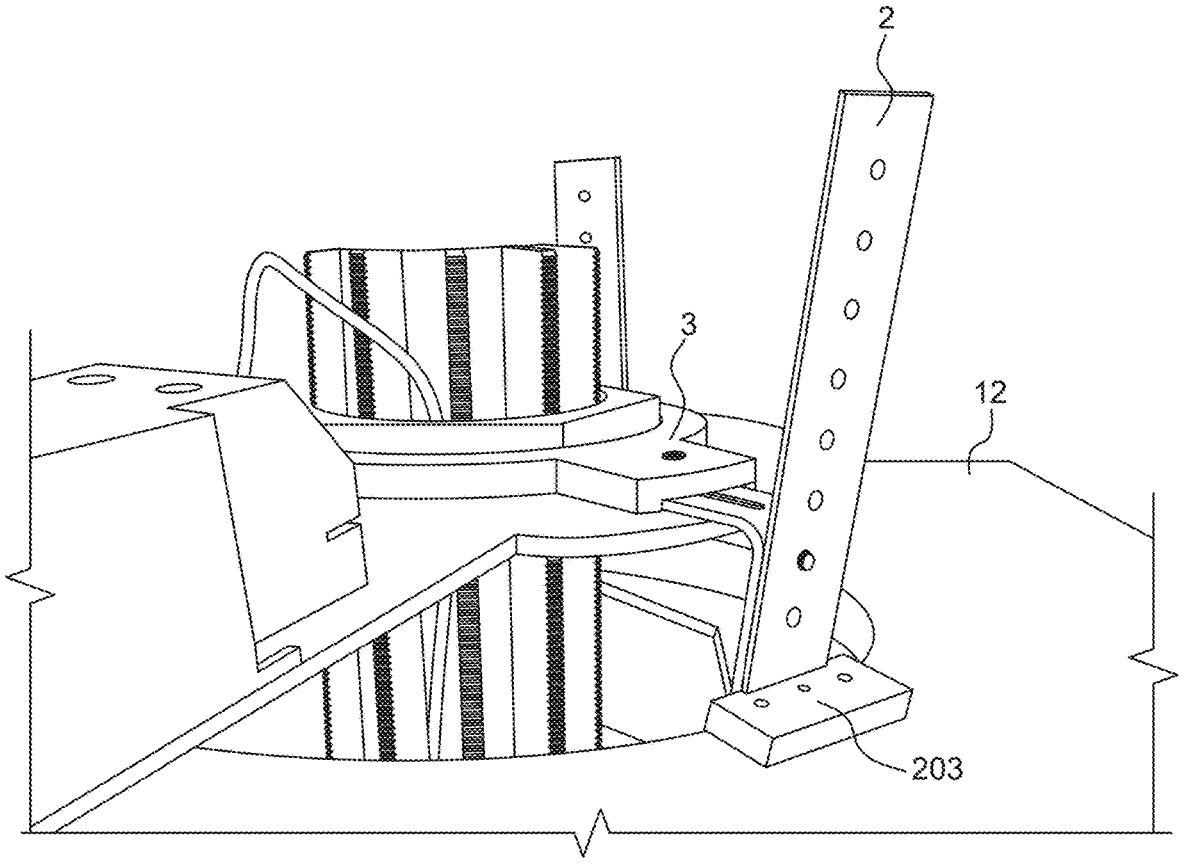
FIG. 10 shows the modular lighting device of FIG. 9 from the side above the ceiling (i.e. the second surface of the ceiling).

FIG. 1C shows a top view of the mounting bracket shown in FIG. 1A. This view displays a first elongated slot 101 with an open end that allows the mounting bracket to move along said slot relative to a plate to which the mounting bracket may be secured/tightened, e.g. by a locking ring. As an example, a screw or preferably a butterfly nut may be used to tighten the mounting brackets to the plate from below, when installing the lighting device. The mounting bracket may comprise a foot configured for mechanically engaging with a first surface of the wall/ceiling. In FIG. 10, the foot 103 of the bracket is visible. The foot of the mounting bracket may comprise one or more holes for receiving one or more first fastening elements for fixing the modular lighting device to the wall/ceiling. In this example, the foot 103 comprises three holes 104, which may be used to fix the bracket to a surface such as a ceiling from below, or a wall. The specified measurements in millimetres are only provided as an example.

Figure 1D:
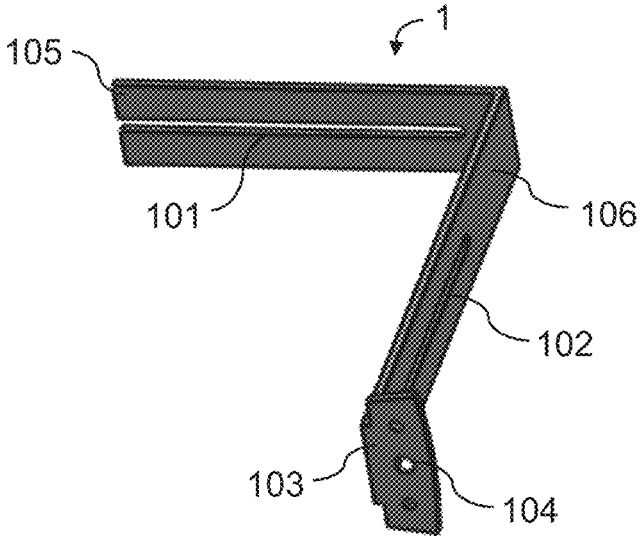
FIG. 1D shows a perspective view of a mounting bracket according to the present disclosure. The mounting bracket preferably comprises a foot 103, said foot comprising one or more holes 104 for receiving one or more first fastening elements.

FIG. 1D shows a perspective view of a mounting bracket 1 according to an embodiment of the present disclosure. The mounting bracket features two elongated slots (101, 102). The first elongated slot 101, which is open in one end, allows the bracket to move relative to a plate 4, to which it can be secured. This feature allows the modular lighting device to be adjusted to a variety of different sized openings in ceilings or walls. Preferably, the lighting device should be able to fit into a range of openings, e.g. with a diameter of 150 mm to 300 mm. The second elongated slot 102, which is closed in both ends, is suitable for attaching a clamp such that the lighting device can be secured to a variety of different ceiling thicknesses or wall thicknesses, e.g. via first fastening element(s) such as a screw through the hole 104.

Figure 2A:
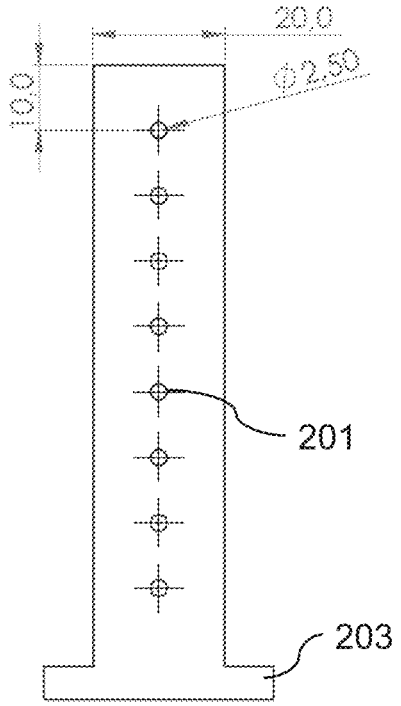
FIG. 2A shows a side view of a clamp suitable for attachment to a mounting bracket. The clamp may comprise one or more holes 201 for attaching the clamp to a mounting bracket by the use of one or more third fastening elements.

FIG. 2A shows a side view of a clamp suitable for attachment to a mounting bracket. The clamp may comprise a hole or a plurality of holes 201 for attaching the clamp to a mounting bracket by the use of one or more third fastening elements. As an example, the third fastening elements may comprise a screw for inserting through one of the holes 201, the screw preferably going through a slot or opening in the mounting bracket. Even more preferably, the holes 201 in the clamp are aligned with the elongated slot 102 such that the third fastening elements may be inserted through the holes 201 and enter through the elongated slot 102. Accordingly, each clamp may comprise one or more holes for receiving one or more third fastening elements for fixing the clamp to the mounting bracket, thereby restraining the movement of the clamp relative to the mounting bracket. Preferably, the third fastening elements may be accessed through the opening in the wall/ceiling, such that the position of each clamp in the mounting bracket may be adjusted when facing the first surface of the wall/ceiling. The third fastening elements may comprise one or more butterfly nuts. Hence, the clamp may be attached to the mounting bracket using a butterfly nut, which is accessible from below the ceiling when the modular lighting device is being installed in a ceiling. The clamp may further comprise a foot 203, which is preferably configured for contacting the upper surface of a ceiling or the surface of a wall, such that a lighting device may be fixed to the ceiling/wall. The specified measurements in millimetres are only provided as an example.

Figure 2B:
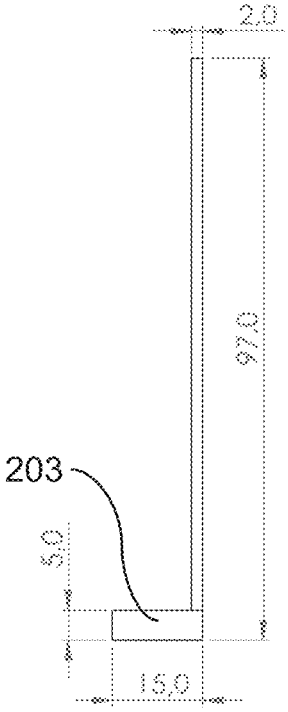
FIG. 2B shows another side view of the exemplary clamp shown in FIG. 2A.

FIG. 2B shows another side view of the clamp shown in FIG. 2A. The specified measurements in millimetres are only provided as an example.

Figure 2C:
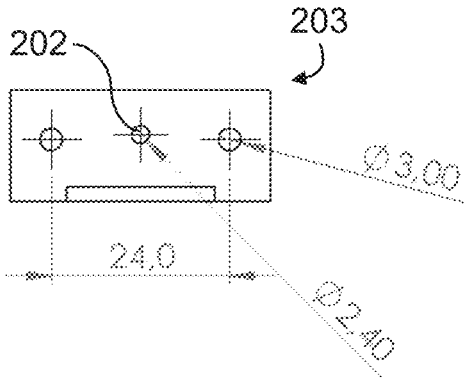
FIG. 2C shows an end view of the clamp shown in FIG. 2A, said view facing the foot 203 of the clamp. The foot may comprise one or more holes 202 for receiving one or more first fastening elements for securing the lighting device to a ceiling or a wall.

FIG. 2C shows a bottom view of the clamp shown in FIG. 2A, i.e. showing a cross-section of the foot 203 of the clamp. The foot may comprise a number of holes 202, such as 1-3 holes, or 3-6 holes, said holes preferably suitable for receiving one or more first fastening elements such as a screw or a bolt for securing the clamp to a ceiling or a wall. Accordingly, the foot of the clamp may comprise one or more holes for receiving the first fastening elements for fixing the modular lighting device to the wall/ceiling. The specified measurements in millimetres are only provided as an example.

Figure 2D:
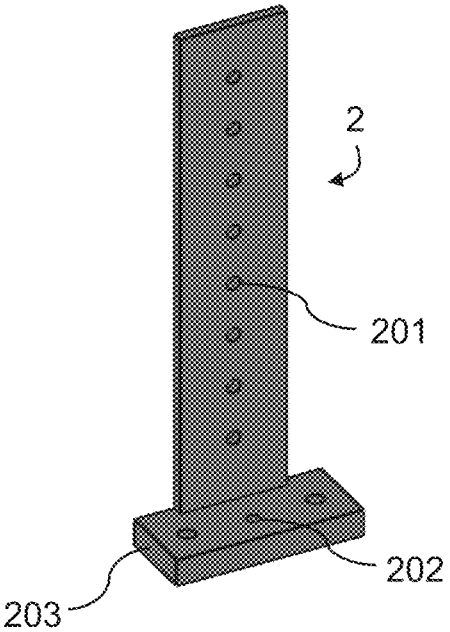
FIG. 2D shows a perspective view of a clamp according to the present disclosure.

FIG. 2D shows a perspective view of a clamp 2 according to an embodiment of the present disclosure. The vertical section of the clamp is suitable for engaging a mounting bracket, and the foot 203 is suitable for engaging a surface such as the upper surface of a ceiling.

FIG. 3A shows a side view of a locking ring according to an embodiment of the present disclosure. The locking ring preferably features a number of small indentations 301 to fit a number of mounting brackets. Each indentation preferably features a hole for receiving second fastening elements such as a screw or a nut for securing the mounting brackets to the plate via the locking ring. The specified measurements in millimetres are only provided as an example.

FIG. 3B shows a bottom view of the exemplary locking ring shown in FIG. 3A. In this embodiment, the locking ring comprises three indentations 301 to fit three mounting brackets. Preferably, the locking ring is configured for receiving the first section 105 of each mounting bracket such that each mounting bracket is movably attached to the modular lightning device. Each indentation features a hole 302 suitable for receiving second fastening elements such as a bolt or a screw for securing the mounting brackets. Preferably, the locking ring is configured for receiving one or more second fastening elements for restraining the mounting brackets to the plate, wherein said second fastening elements mechanically engage with the locking ring, the mounting bracket, and the plate. The specified measurements in millimetres are only provided as an example.

Figure 3C:
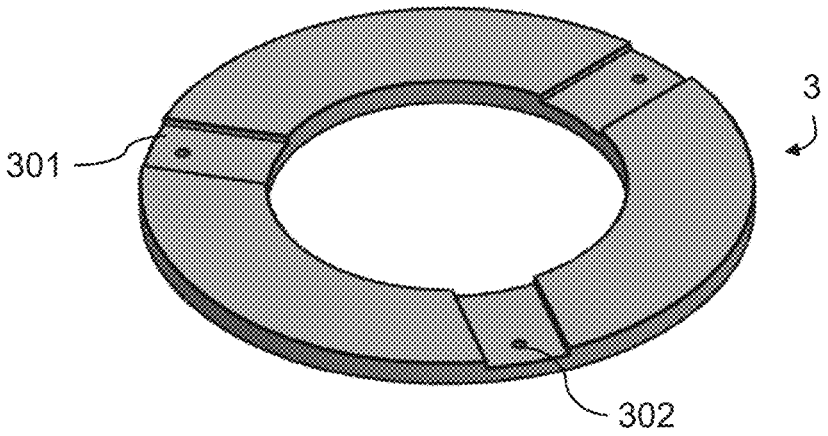
FIG. 3C shows a perspective view of the locking ring shown in FIG. 3B.

FIG. 3C shows a 3D view of the locking ring shown in FIG. 3B. The locking ring is seen from below, i.e. the three indentations 301 are preferably located on the bottom side of the locking ring 3.

Figure 4A:
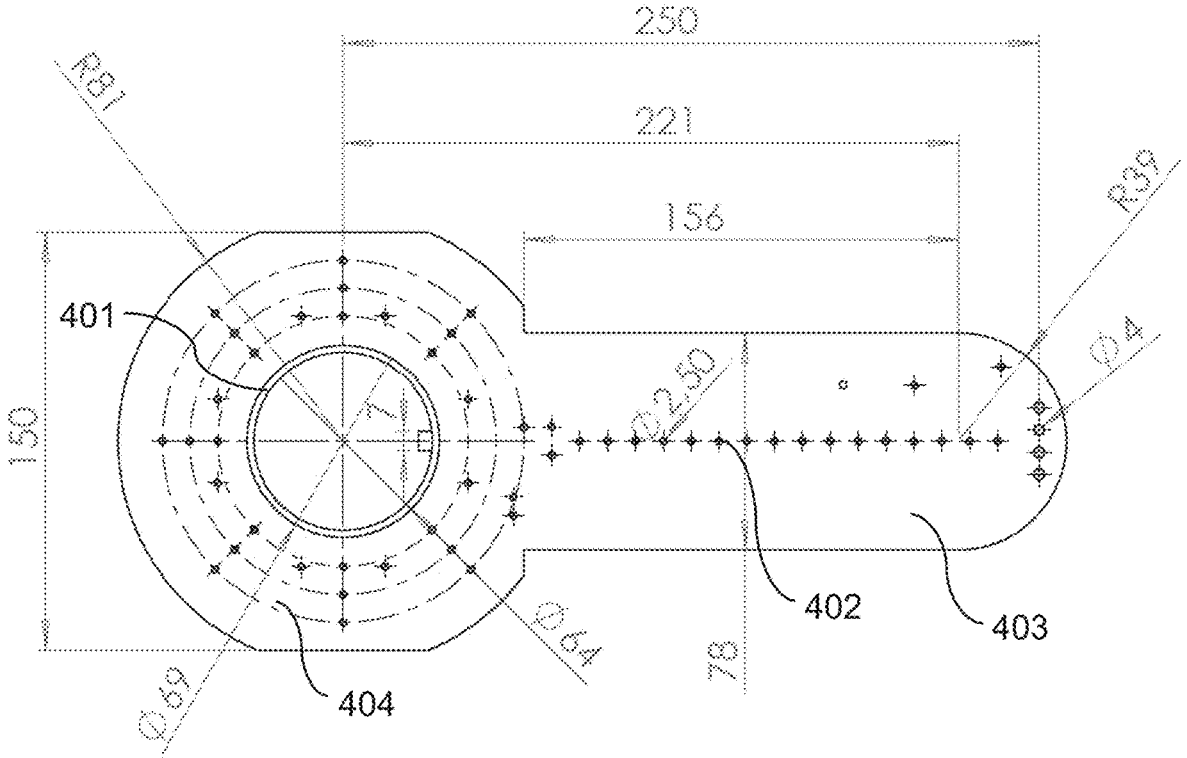
FIG. 4A shows a top view of a plate according to an embodiment of the present disclosure. The plate preferably comprises an opening 401 suitable for receiving a lamp fitting.

FIG. 4A shows a top view of a plate according to an embodiment of the present disclosure. The plate may feature an opening 401 suitable for receiving a lamp fitting. The plate may additionally feature a plurality of smaller holes 402 for securing various objects to the plate, e.g. mounting brackets, or a driver for the light source. According to this embodiment, the plate has a geometry consisting of a substantially round/circular section 404 and a longer, elongated section 403 suitable for holding a driver. The specified measurements in millimetres are only provided as an example.

Figure 4B:
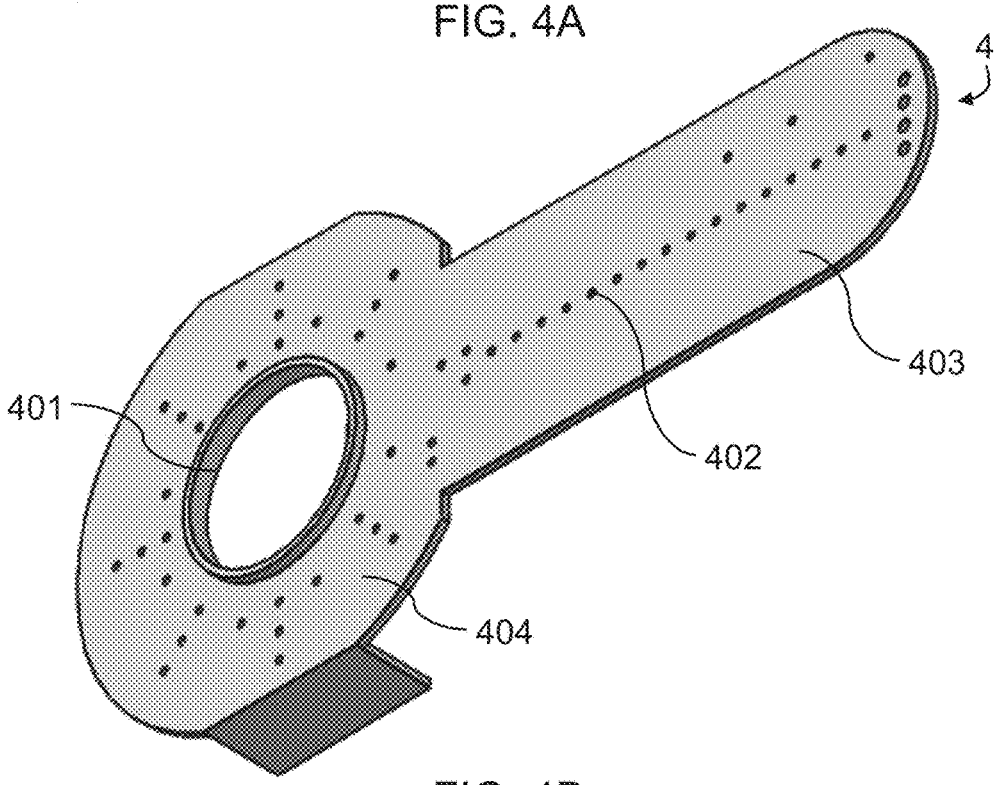
FIG. 4B shows a perspective view of the plate shown in FIG. 4A.

FIG. 4B shows a perspective view of the exemplary plate shown in FIG. 4A.

FIG. 5 shows a modular lighting device according to an embodiment of the present disclosure. The modular lighting device is shown here to comprise a plate 4 for holding a driver, three mounting brackets 1 with elongated slots oriented both vertically and horizontally, a clamp 2 attached to one of the mounting brackets, and a locking ring 3 on top of the plate, the locking ring securing the three mounting brackets to the plate.

Figure 6A:
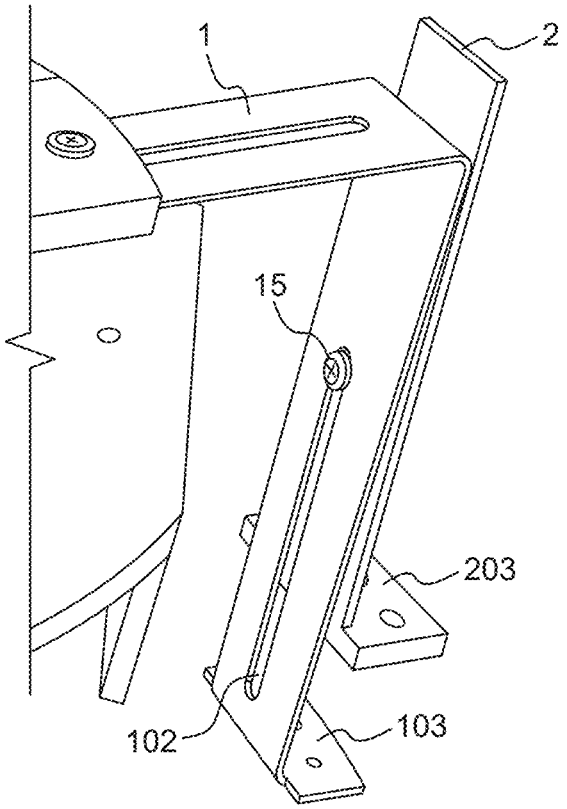
FIG. 6A shows a mounting bracket 1 with a clamp 2 attached thereto. The clamp can be adjusted up/down via the combination of the second elongated slot 102 and the third fastening element 15 (here embodied as a screw) to fit various ceiling/wall thicknesses.

FIG. 6A shows a mounting bracket 1 with a clamp 2 attached thereto, according to an embodiment of the present disclosure. The clamp can be adjusted up/down via the combination of the second elongated slot 102 and the third fastening element (here embodied as a screw) to fit various ceiling/wall thicknesses. The ceiling/wall is supposed to fit between the lower surface of the bottom foot 203 of the clamp and the upper surface of the foot 103 of the mounting bracket. The two feet (103, 203) preferably comprise holes for receiving one or more first fastening elements for fixing the lighting device to the ceiling/wall. Any of the first, the second, or the third fastening elements may comprise one or more screws, bolts, nuts, or combinations thereof.

Figure 6B:
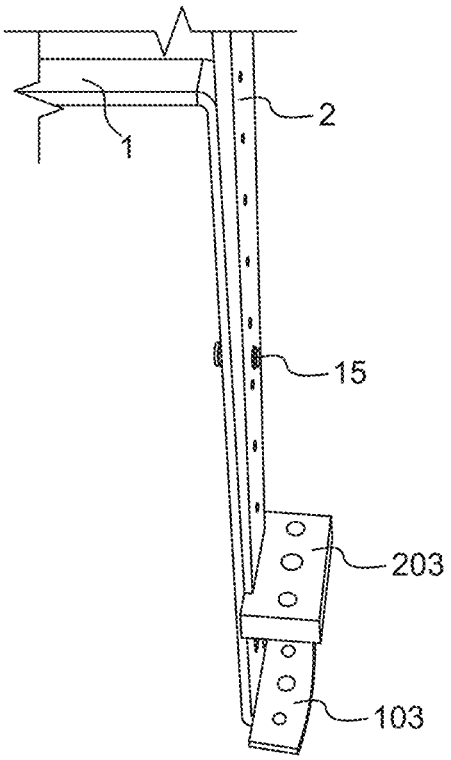
FIG. 6B shows the mounting bracket of FIG. 6A viewed from the side.

FIG. 6B shows the mounting bracket of FIG. 6A viewed from the side.

FIG. 7 shows a modular lighting device according to an embodiment of the present disclosure, wherein some different components are attached to the lighting device. The figure shows the modular lighting device when fitted to an opening. In this example, a driver 5 is mounted on the plate 4. A lamp fitting 6 comprising a heat sink is fitted inside the opening 401 of the plate. A light source 7 is fitted to the lamp fitting. The clamps 2 have been adjusted such that the foot 203 of the clamp engages with the upper side of the ceiling. This embodiment comprises relative long second sections 106 of the brackets such that a reflector can be fitted to the lighting device.

FIG. 8 shows a modular lighting device according to an embodiment of the present disclosure, wherein a reflector 8 is fitted to the lighting device.

Figure 9:
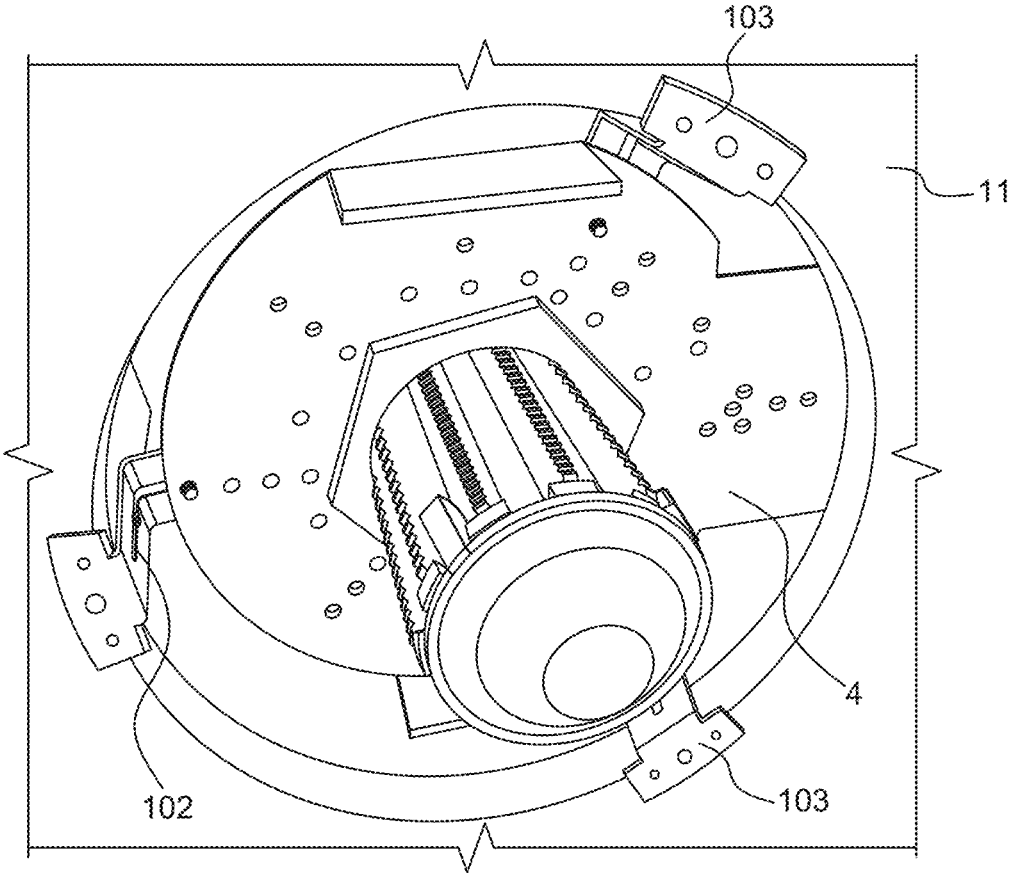
FIG. 9 shows a modular lighting device according to an embodiment of the present disclosure. This embodiment features shorter second sections of the mounting brackets, and correspondingly shorter second elongated slots 102.

FIG. 9 shows a modular lighting device according to an embodiment of the present disclosure. This embodiment features shorter second sections of the mounting brackets, and correspondingly shorter second elongated slots 102. This allows the lamp fitting and the light source to extend below the ceiling.

FIG. 10 shows the modular lighting device of 10 from the side above the ceiling (i.e. the second surface of the ceiling).

Figure 11:
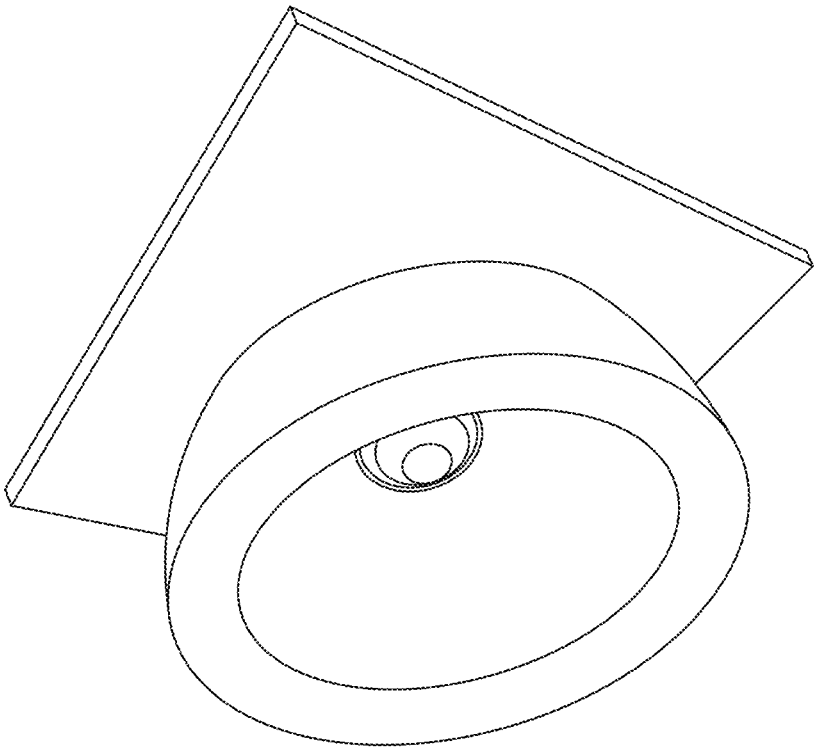
FIG. 11 shows a modular lighting device installed in a ceiling according to an embodiment of the present disclosure. In this embodiment, a pendant is attached to the lighting device.

FIG. 11 shows a modular lighting device installed in a ceiling according to an embodiment of the present disclosure. In this embodiment, an exemplary pendant is attached to the lighting device for illustrative purposes.

Figure 12:
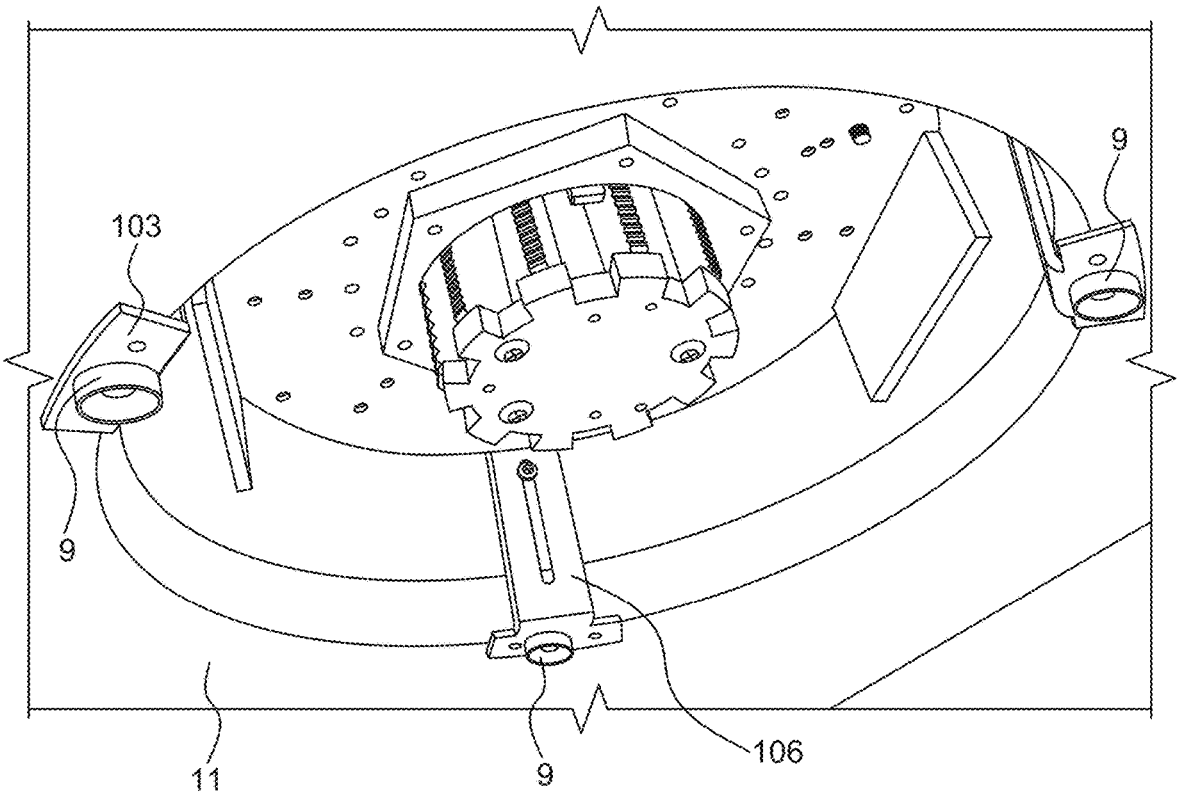
FIG. 12 shows a modular lighting device according to an embodiment of the present disclosure, wherein magnets 9 are attached underneath the foot 103 of each mounting bracket.
Figure 13:
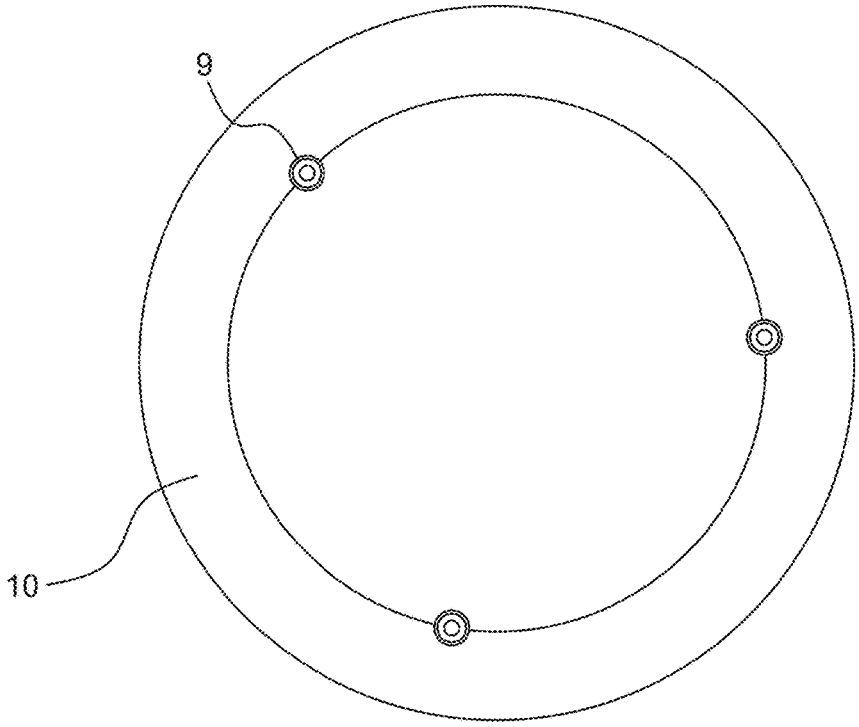
FIG. 13 shows a modular lighting device according to an embodiment of the present disclosure, wherein a diffuser 10 is attached to the lighting device using magnets 9. Preferably, one magnet is used for each mounting bracket.

FIG. 12 shows a modular lighting device according to an embodiment of the present disclosure, wherein magnets 9 are attached underneath the foot 103 of each mounting bracket.

FIG. 13 shows a modular lighting device according to an embodiment of the present disclosure, wherein a diffuser 10 is attached to the lighting device using magnets 9. Preferably, one magnet is used for each mounting bracket.

Figure 14:
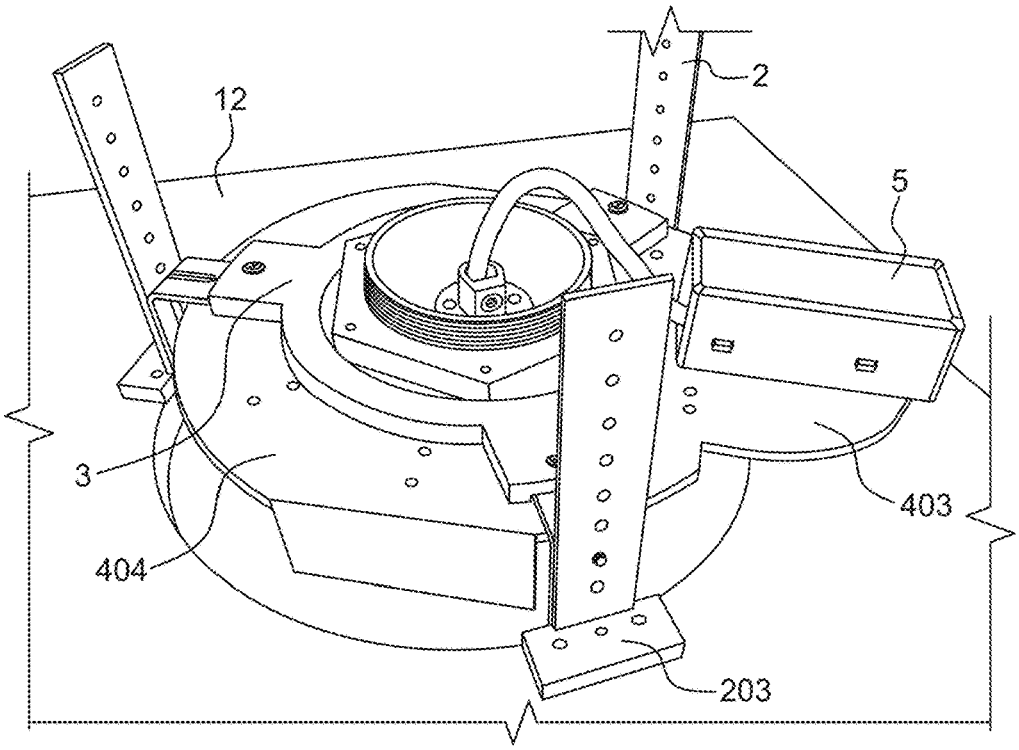
FIG. 14 shows a modular lighting device according to an embodiment of the present disclosure, wherein the elongated part 403 of the plate is shorter. This plate is suitable for holding a smaller driver 5.

FIG. 14 shows a modular lighting device according to an embodiment of the present disclosure, wherein the elongated part 403 of the plate is shorter. This plate is suitable for holding a smaller driver 5.

FIG. 15 shows a modular lighting device according to an embodiment of the present disclosure. In this embodiment, a lamp fitting 6 is attached to the lighting device. A light source 7 is fitted inside the lamp fitting. The embodiment features a number of magnets 9 for attaching other components, e.g. a diffuser, to the lighting device.

EXAMPLES

Examples of drivers compatible with the disclosed modular lighting device are Philips Xitanium LED drivers, such as the Philips Xitanium 16 W/m 0.35 A 46V SC 230V or the Philips Xitanium 50 W WH 0.7-1.5 A 54V TD/Is 230V.

REFERENCE NUMERALS

1. Mounting bracket
2. Clamp
3. Locking ring
4. Plate
5. Driver
6. Lamp fitting
7. Light source
8. Reflector
9. Magnets
10. Diffuser
11. First surface of the wall/ceiling
12. Second surface of the wall/ceiling
13. First fastening elements
14. Second fastening elements
15. Third fastening elements
101. First elongated slot
102. Second elongated slot
103. Foot of the mounting bracket
104. Holes in the foot of the mounting bracket
105. First section of the mounting bracket
106. Second section of the mounting bracket
201. Holes in the clamp
202. Holes in the foot of the clamp
203. Foot of the clamp
301. Indentation in the locking ring
302. Hole in the locking ring
401. Opening in the plate
402. Holes in the plate
403. Elongated part of the plate
404. Rounded section of the plate

The invention claimed is:

1. A modular lighting device for countersunk fitting into an opening in a ceiling or a wall, the modular lighting device comprising:

a plate for receiving a lamp fitting;

at least three mounting brackets;

a locking ring for restraining said mounting brackets to the plate, wherein the modular lightning device is configured such that the modular lightning device can be fitted to different sized openings via radial adjustment of the mounting brackets, wherein each mounting bracket comprises a first elongated slot provided in a first section of the mounting bracket, said first slot enabling the radial adjustment of each mounting bracket, and wherein each mounting bracket comprises a second elongated slot provided in a second section of the mounting bracket; and a plurality of clamps, each of said clamps being moveably attached to a mounting bracket, wherein each mounting bracket comprises a foot configured for mechanically engaging with a first surface of the wall/ceiling, and each clamp comprises a foot configured for mechanically engaging with a second surface of the wall/ceiling, the foot of the mounting bracket and the foot of the clamp defining an adjustable gap for accommodating different wall/ceiling thicknesses; and wherein the foot of each mounting bracket comprises one or more holes for receiving one or more first fastening elements, and wherein the foot of each clamp comprises one or more holes for receiving said first fastening elements for fixing the modular lighting device to the wall/ceiling.

2. The modular lighting device according to claim 1, wherein each mounting bracket comprises a foot configured for mechanically engaging with a first surface of the wall/ceiling.

3. The modular lighting device according to claim 2, wherein the foot of each mounting bracket comprises one or more holes for receiving one or more first fastening elements for fixing the modular lighting device to the wall/ceiling.

4. The modular lighting device according to claim 2, wherein the foot of each mounting bracket is configured for attaching one or more magnets such that a diffuser may be removably attached to the modular lighting device.

5. The modular lighting device according to claim 1, wherein the locking ring is configured for receiving the first section of each mounting bracket such that each mounting bracket is movably attached to the modular lightning device.

6. The modular lighting device according to claim 1, wherein the locking ring comprises an indentation for each mounting bracket, said indentation in combination with the plate defining an opening for receiving the mounting bracket.

7. The modular lighting device according to claim 1, wherein the locking ring is configured for receiving one or more second fastening elements for restraining the mounting brackets to the plate, wherein said second fastening elements mechanically engage with the locking ring, the mounting bracket, and the plate.

8. The modular lighting device according to claim 7, wherein the second fastening elements are accessible through the opening in the wall/ceiling, such that the mounting brackets may be radially adjusted when facing the first surface of the wall/ceiling.

9. The modular lighting device according to claim 8, wherein the second fastening elements comprise one or more butterfly nuts.

10. The modular lighting device according to claim 1, wherein the modular lightning device is configured to fit different wall/ceiling thicknesses.

11. The modular lighting device according to claim 1, wherein each clamp is configured for sliding in the second elongated slot of the mounting bracket, such that the movement of each clamp is confined to the dimensions of the second elongated slot.

12. The modular lighting device according to claim 1, wherein each clamp comprises one or more holes for receiving one or more third fastening elements for fixing the clamp to the mounting bracket, thereby restraining the movement of the clamp relative to the mounting bracket.

13. The modular lighting device according to claim 12, wherein the third fastening elements are accessible through the opening in the wall/ceiling, such that the position of each clamp in the mounting bracket may be adjusted when facing a first surface of the wall/ceiling.

14. The modular lighting device according to claim 13, wherein the third fastening elements comprise one or more butterfly nuts.

* * * * *